US006830319B2

(12) United States Patent
Harajiri et al.

(10) Patent No.: US 6,830,319 B2
(45) Date of Patent: Dec. 14, 2004

(54) HEAD CHIP AND METHOD OF PRODUCING THE SAME

(75) Inventors: Toshihiko Harajiri, Chiba (JP); Yutaka Hongou, Chiba (JP)

(73) Assignee: SII Printek Inc., Chiba (JP)

( * ) Notice: Subject to any disclaimer, the term of this patent is extended or adjusted under 35 U.S.C. 154(b) by 67 days.

(21) Appl. No.: 10/383,050

(22) Filed: Mar. 6, 2003

(65) Prior Publication Data

US 2003/0193550 A1 Oct. 16, 2003

(30) Foreign Application Priority Data

Apr. 16, 2002 (JP) ..... 2002-113578
Nov. 28, 2002 (JP) ..... 2002-347688

(51) Int. Cl.[7] ..... B41J 2/045
(52) U.S. Cl. ..... 347/68
(58) Field of Search ..... 347/68, 71, 72

(56) References Cited

U.S. PATENT DOCUMENTS 5,619,235 A * 4/1997 Suzuki ..... 347/69
6,415,507 B1 * 7/2002 Shimosato et al. ..... 29/890.1

FOREIGN PATENT DOCUMENTS

JP 2002-113578 4/2002
JP 2002-347688 11/2002

* cited by examiner

*Primary Examiner*—Thinh Nguyen
(74) *Attorney, Agent, or Firm*—Adams & Wilks

(57) ABSTRACT

Disclosed is a head chip and a method of producing the same which help to achieve an improvement in production yield and a reduction in production cost and which allow high speed printing and high density printing. The head chip is of the type in which grooves defined by side walls are provided in one surface of a substrate and in which by applying voltage to electrodes provided on the side walls, ink in the grooves is ejected from nozzle openings of a nozzle plate joined to one surface of the substrate, wherein the plurality of piezoelectric ceramic members extending in a reference direction are embedded in one surface of an insulating main body of the substrate to form the substrate, wherein the grooves are formed at predetermined intervals so as to extend over the row of piezoelectric ceramic members to thereby provide the side walls, wherein the electrodes are provided in the regions of the side walls where the piezoelectric ceramic members are provided to thereby form drive portions for independent driving, and wherein the nozzle openings are provided at positions corresponding to the drive portions of the grooves to form the plurality of nozzle rows.

20 Claims, 14 Drawing Sheets

HEAD CHIP AND METHOD OF PRODUCING THE SAME

BACKGROUND OF THE INVENTION

1. Field of the Invention

The present invention relates to a head chip to be mounted on an ink-jet recording apparatus applicable, for example, to a printer, a facsimile apparatus, or an on-demand printer, and to a method of producing the head chip.

2. Description of the Related Art

An ink-jet recording apparatus has been known which records characters and images on a recording medium by using an ink-jet head on which there is mounted a head chip having a plurality of nozzles for ejecting ink.

Examples of the conventional ink-jet recording apparatus include a serial type ink-jet recording apparatus in which the nozzles of the head chip are arranged in the ink-jet head so as to be opposed to the recording medium and in which scanning is effected with the ink-jet head in a direction perpendicular to the transporting direction of the recording medium to thereby perform printing, and a line type ink-jet recording apparatus in which the ink-jet head is stationary, printing being effected by moving the recording medium alone.

Examples of the head chip to be mounted on a conventional ink-jet head are disclosed, for example, in JP2000-512233A and JP2000-296618 A (See Patent Documents 1 and 2).

FIGS. 10A and 10B are sectional views showing the conventional head chip as disclosed in the former document.

As shown in FIG. 10A, a head chip 100 comprises: a substrate 120 composed of a substrate main body 121 formed of an insulating material such as alumina and having in one surface thereof a recess, and piezoelectric ceramic members 122 provided in the recess and having a plurality of grooves 125 extending in a direction perpendicular to the longitudinal direction thereof; and a nozzle plate 140 joined to the substrate 120 so as to cover the open side of the recess and having nozzle openings 141.

Formed in the substrate main body 121 are chambers 130 defined by the piezoelectric ceramic members 122 at either end of the recess in the width direction so as to extend in the longitudinal direction.

Further, electrodes 127 are formed on side walls 126 defining the grooves 125 of the piezoelectric ceramic 122, and each electrode 127 is electrically connected to a lead wiring provided on the recess side surface of the nozzle plate 140.

Further, in the bottom surface of the substrate main body 121, there are provided an ink supply hole 131 and an ink discharge hole 132 for supplying and discharging ink to and from each chamber 130.

In this head chip 100, ink is supplied from one chamber 130, and supplied to the other chamber 130 through the grooves 125 of the piezoelectric ceramic 122, whereby ink is supplied to the interior of the grooves 125.

And, by applying voltage to the electrodes 127 provided on the side walls 126, the side walls 126 undergo shear mode displacement, whereby the ink filling the grooves 125 is ejected through the nozzle openings 141.

To perform high speed printing with this head chip 100 with the number of nozzle openings 141 increased, piezoelectric ceramic members 122 with the plurality of grooves 125 are provided side by side in the recess of the substrate main body 121, and the nozzle openings 141 are provided in the areas opposed to the grooves 125, as shown in FIG. 10B, whereby the number of nozzle openings 141 in the head chip 100 is doubled.

In producing this head chip 100, the recess is formed in the substrate main body 122, and the piezoelectric ceramic members 122 with the plurality of grooves 125 are positioned and secured to predetermined positions on the bottom surface of the recess to form the substrate 120, and then the nozzle plate 140 is joined to the substrate to complete the head chip 100.

FIG. 11 shows a head chip as disclosed in the latter document. FIG. 11 is a cut-away perspective view of a main portion of the conventional head chip.

As shown in the drawing, a head chip 200 includes a substrate 220 consisting of a substrate main body 221 formed of an insulating material such as alumina and equipped with a recess 224 open at one end surface and one surface, and piezoelectric ceramic members 222 embedded in the recess 224, wherein a plurality of grooves 225 are defined by side walls 226 so as to extend over the substrate main body 221 and the piezoelectric ceramic members 222 and in the longitudinal direction of the recess 224.

One end portion of each of the grooves 225 formed in the substrate 220 is open at one end surface of the piezoelectric ceramic members 222, and the other end portions thereof extend up to the substrate main body 221 with their depth gradually decreasing.

Further, electrodes (not shown) are provided on the side walls 226 defining the grooves 225 of the piezoelectric ceramic 222, and the electrodes are electrically connected to lead wiring 227*a* provided in the region of the substrate main body 221 where no grooves 225 are formed.

Further, a nozzle plate 240 having nozzle openings 241 at regions opposed to the grooves 225 is joined to one end surface of the substrate 220 where the grooves 225 are open, and on one side of the substrate 220 where the grooves 225 are open, there is provided an ink chamber 230 communicating with the grooves 225 and adapted to supply ink to the grooves 225. Further, joined to this side of the substrate is an ink chamber plate 231 for sealing the region of the grooves 225 which does not face the ink chamber 230.

In producing this head chip 200, the recess 224 is formed in the substrate main body 221, and the piezoelectric ceramic 222 is embedded in the recess 224 to thereby form the substrate 220, the grooves 225 being formed by simultaneously grinding the substrate main body 221 and the piezoelectric ceramic 222 with a dicer using a disc-shaped dice cutter. And, the electrodes are formed-on the side walls 226 defining the grooves 225, and the lead wiring 227*a* is formed in the substrate main body 221, the nozzle plate 240 and the ink chamber plate 231 being joined to the substrate to form the head chip 200.

In this head chip 200, the piezoelectric ceramic 222 is embedded in the substrate main body 221, and then the plurality of grooves 225 are formed, so that it is possible to reduce product defects and to achieve an improvement in yield.

In the former type of head chip, however, it is necessary to perform positioning on the piezoelectric ceramic members when fixing them to predetermined positions on the bottom surface of the recess of the substrate main body, and high precision positioning is rather difficult to perform.

Further, in the former type of head chip, when forming grooves in the piezoelectric ceramic members, the side walls defining the grooves are subject to breakage, resulting in poor yield.

In the former type of head chip, the number of nozzle openings can be doubled by arranging the piezoelectric ceramic members side by side in the recess, so that it allows high speed printing in a serial type ink-jet recording apparatus, in which the ink-jet head with the head chip mounted thereon is moved in a direction perpendicular to the transporting direction of the recording medium, whereas, in a line type ink-jet recording apparatus, in which the recording medium is moved with the ink-jet head being stationary, the nozzle opening positions in the row direction are the same in each row of nozzle openings, so that it is impossible to perform high density printing.

On the other hand, in the latter type of head chip, when the number of nozzle openings are to be increased in order to perform high speed printing or high density printing, the head chips have to be arranged side by side, which leads to an increase in head chip size and an increase in cost.

Further, when a conductive ink such as a water-color ink is used in the head chips of both types, adjacent electrodes provided on side walls defining a groove conduct to eliminate the potential difference, with the result that the side walls do not undergo deformation, making it impossible to eject ink.

In view of this, there have been proposed a method according to which the grooves communicating with the nozzle openings and used for ink ejection are arranged at intervals and used as chambers, with the grooves not used for ink ejection being used as dummy chambers, and a method according to which insulating films covering the electrodes are provided on the surfaces of the electrodes in the grooves.

In the former method, in order that the dummy chambers may be filled with no ink and that only the chambers may be selectively filled with ink, there is provided a partition having openings solely in the regions opposed to the chambers, whereby the electrodes provided on the inner surfaces of the side walls of the chambers are used as common electrodes with the same potential in all the chambers. Further, the electrodes on the outer surfaces of the side walls of the chambers are used as individual electrodes for selectively driving the chambers, whereby an electric field is applied to the side wall on either side of the chamber to thereby eject ink.

However, this requires provision and machining of a partition, resulting in a rather high cost.

In the latter method, when dirt or the like generated during the production process exists under the insulating film, the insulating film will be peeled off during use of the head chip.

SUMMARY OF THE INVENTION

The present invention has been made in view of the above problems in the prior art. It is an object of the present invention to provide a head chip and a method of producing the same which help to attain an improvement in yield and a reduction in production cost and which allow high speed printing and high density printing.

According to a first aspect of the present invention for solving the above-mentioned problem, there is provided a head chip in which grooves defined by side walls are provided in one surface of a substrate and in which by applying voltage to electrodes provided on the side walls, ink in the grooves is ejected from nozzle openings of a nozzle plate joined to one surface of the substrate, characterized in that: a plurality of piezoelectric ceramic members extending in a reference direction are embedded in one surface of an insulating main body of the substrate to form the substrate; the grooves are formed at predetermined intervals so as to extend over the row of piezoelectric ceramic members to thereby provide the side walls; the electrodes are provided in the regions of the side walls where the piezoelectric ceramic members are provided to thereby form drive portions for independent driving; and the nozzle openings are provided at positions corresponding to the drive portions of the grooves to form the plurality of nozzle rows.

According to a second aspect of the present invention, in the first aspect of the invention, the head chip is characterized in that: the grooves are formed in a direction inclined by a predetermined angle from a direction perpendicular to the reference direction over the row of piezoelectric ceramic members; and the positions in the reference direction of all the nozzle openings of the plurality of nozzle rows differ from one another.

According to a third aspect of the present invention, in the first or second aspect of the invention, the head chip is characterized in that in the regions of the other surface of the substrate not opposed to the piezoelectric ceramic members, there are formed an ink supply hole for supplying ink to the grooves and an ink discharge hole for discharging the ink in the grooves.

According to a fourth aspect of the present invention, in the third aspect of the invention, the head chip is characterized in that: in the regions of the other surface of the substrate not opposed to the piezoelectric ceramic members, there are formed the plurality of common grooves extending in the same direction as the reference direction and over the direction in which the grooves are arranged side by side and communicating with bottoms of the grooves; and communication holes through which the common grooves communicate with the grooves constitute the ink supply hole and the ink discharge hole.

According to a fifth aspect of the present invention, in the fourth aspect of the invention, the head chip is characterized in that: the grooves are formed by alternately arranging chambers to be filled with ink and dummy chambers to be filled with no ink; and the dummy chambers are shallower than the chambers, whereby the common grooves communicate exclusively with the bottoms of the chambers.

According to a sixth aspect of the present invention, in the fourth aspect of the invention, the head chip is characterized in that the side walls are missing in the regions in contact with the piezoelectric ceramic members.

According to a seventh aspect of the present invention, in any one of the first to sixth aspects of the invention, the head chip is characterized in that: two of the piezoelectric ceramic members are arranged side by side in the substrate; and the electrodes are provided individually on the side walls so as to extend from the ends of the grooves to regions opposed to the drive portions.

According to an eighth aspect of the present invention, in any one of the first to seventh aspects of the invention, the head chip is characterized in that the piezoelectric ceramic members are embedded in the substrate so as to reach the bottoms of the grooves.

According to a ninth aspect of the present invention, in the eighth aspect of the invention, the head chip is characterized in that: the piezoelectric ceramic members exhibit different polarizing directions substantially at the center with respect to the depth direction of the grooves; and the electrodes are provided on the entire surfaces of the side walls where the piezoelectric ceramic members are exposed.

According to a tenth aspect of the present invention, in any one of the first to ninth aspects of the invention, the head chip is characterized in that the end portions of the grooves are formed so as to be gradually reduced in depth.

According to an eleventh aspect of the present invention, in any one of the first to tenth aspects of the invention, the head chip is characterized in that the substrate is formed of a material whose coefficient of linear expansion is substantially the same as that of the piezoelectric ceramic members.

According to a twelfth aspect of the present invention, in any one of the first to eleventh aspects of the invention, the head chip is characterized in that the substrate is formed of a ceramic material such as alumina.

According to a thirteenth aspect of the present invention, there is provided a head chip producing method characterized by including: forming a substrate by embedding the plurality of piezoelectric ceramic members extending in a reference direction in one surface of an insulating substrate main body; forming grooves at predetermined intervals so as to extend over the row of piezoelectric members to thereby form side walls defining the grooves; forming electrodes in the regions of the side walls where the piezoelectric ceramic members are provided to thereby form drive portions for independent driving; and joining a nozzle plate in which nozzle openings are provided at equal intervals and in a plurality of rows at positions corresponding to the drive portions of the grooves to one surface of the substrate.

According to a fourteenth aspect of the present invention, in the thirteenth aspect of the invention, the head chip producing method is characterized in that: in forming the grooves, the grooves are formed in a direction inclined by a predetermined angle from a direction perpendicular to the reference direction; and the positions in the reference direction of all the nozzle openings of the plurality of rows differ from each other.

According to a fifteenth aspect of the present invention, in the thirteenth or fourteenth aspect of the invention, the head chip producing method is characterized in that in embedding the piezoelectric ceramic members in the substrate, recesses of the same size as the piezoelectric ceramic members are formed in the substrate, and then the piezoelectric ceramic members are joined into the recesses.

According to a sixteenth aspect of the present invention, in the thirteenth or fourteenth aspect of the invention, the head chip producing method is characterized in that: in embedding the piezoelectric ceramic members in the substrate, a step-like recess having an upper recess and a lower recess having a step portion larger than the piezoelectric ceramic members is formed in the substrate; and the piezoelectric ceramic members are joined to a bottom surface portion of the lower recess and side surface portions of the lower recess.

According to a seventeenth aspect of the present invention, in any one of the thirteenth to sixteenth aspects of the invention, the head chip producing method is characterized by further including forming, in regions of the other surface of the substrate not opposed to the piezoelectric ceramic members, a plurality of common grooves extending in the same direction as the piezoelectric ceramic members and over the direction in which the grooves are arranged side by side and communicating with the bottom portions of the grooves.

According to an eighteenth aspect of the present invention, in the seventeenth aspect of the invention, the head chip producing method is characterized in that: in forming the grooves, grooves having different depths are alternately formed; and the common grooves are formed so as not to communicate with bottom portions of shallower grooves.

According to a nineteenth aspect of the present invention, in any one of the thirteenth to eighteenth aspects of the invention, the head chip, producing method is characterized in that in embedding the piezoelectric ceramic members in the substrate, the piezoelectric ceramic members are embedded in the substrate so as to reach the bottom surfaces of the grooves.

According to a twentieth aspect of the present invention, in the nineteenth aspect of the invention, the head chip producing method is characterized in that: the piezoelectric ceramic members exhibit different polarizing directions substantially at the center with respect to the depth direction of the grooves; and in forming the drive portions, the electrodes are provided on the entire surfaces of the sidewalls where the piezoelectric ceramic members are exposed.

In the present invention, the plurality of piezoelectric ceramic members are embedded in the substrate main body, and grooves are provided so as to extend over the row of piezoelectric ceramic members, so that the side walls defining the grooves are reliably prevented from being broken during formation of the grooves, thereby making it possible to achieve an improvement in production yield. Further, since the piezoelectric ceramic members are embedded in the substrate main body, there is no need to perform positioning on the piezoelectric ceramic members with respect to the predetermined positions, making it possible to form a high precision head chip with ease.

Further, by providing the plurality of nozzle rows in each of which nozzle openings are arranged side by side, it is possible to realize high speed printing, and, by deviating the position of each nozzle row in the row direction, it is possible to realize high density printing.

Further, by providing ink supply holes for supplying ink to the bottom surfaces of the grooves and alternately arranging grooves with different depths, it is possible to selectively supply ink to the grooves and to use a conductive ink such as a water-color ink.

DETAILED DESCRIPTION OF THE PREFERRED EMBODIMENTS

Embodiments of the present invention will now be described in detail.

(Embodiment 1)

Figure 1:
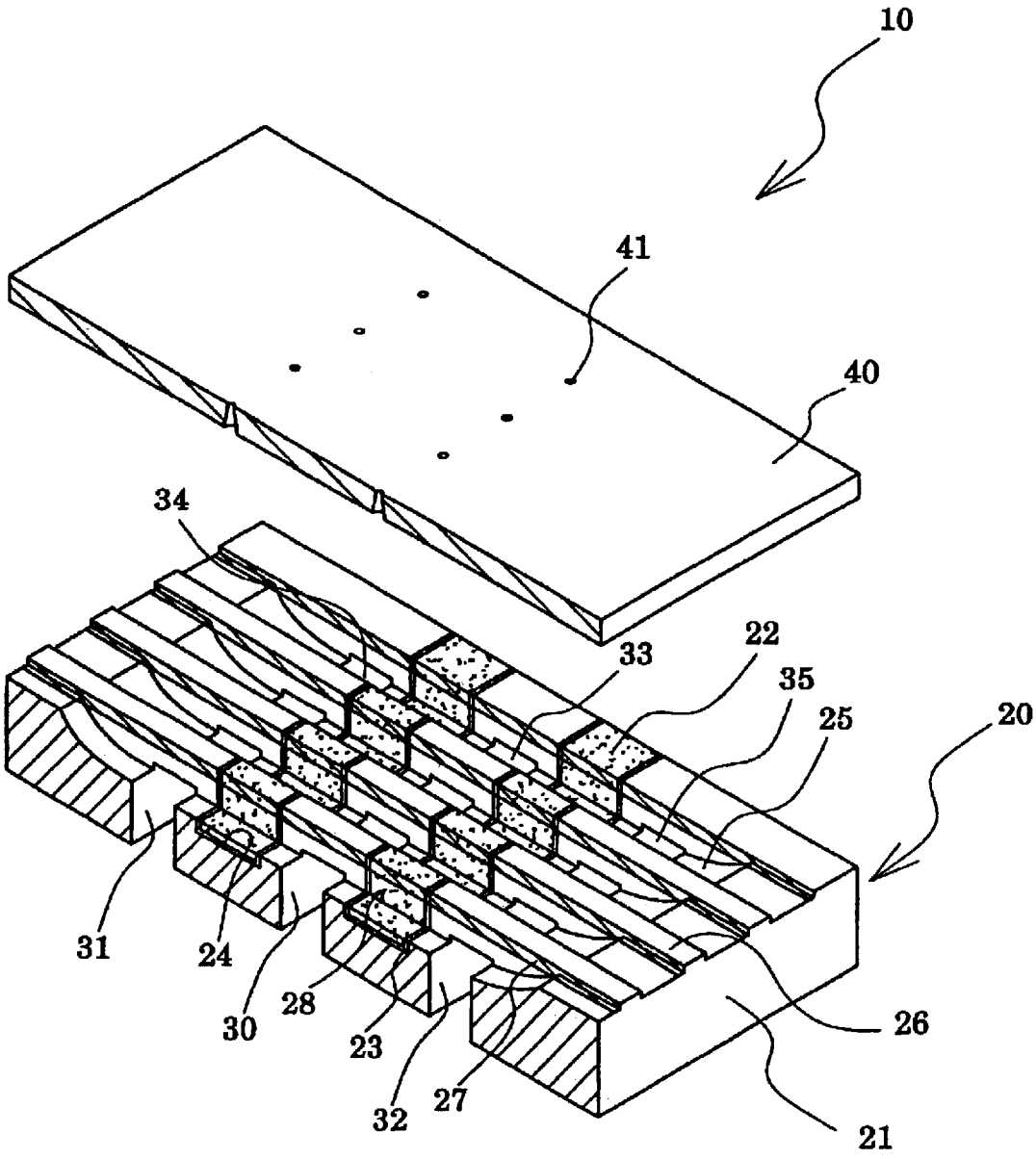
FIG. 1 is an exploded perspective view of a head chip according to Embodiment 1 of the present invention.
Figure 2:
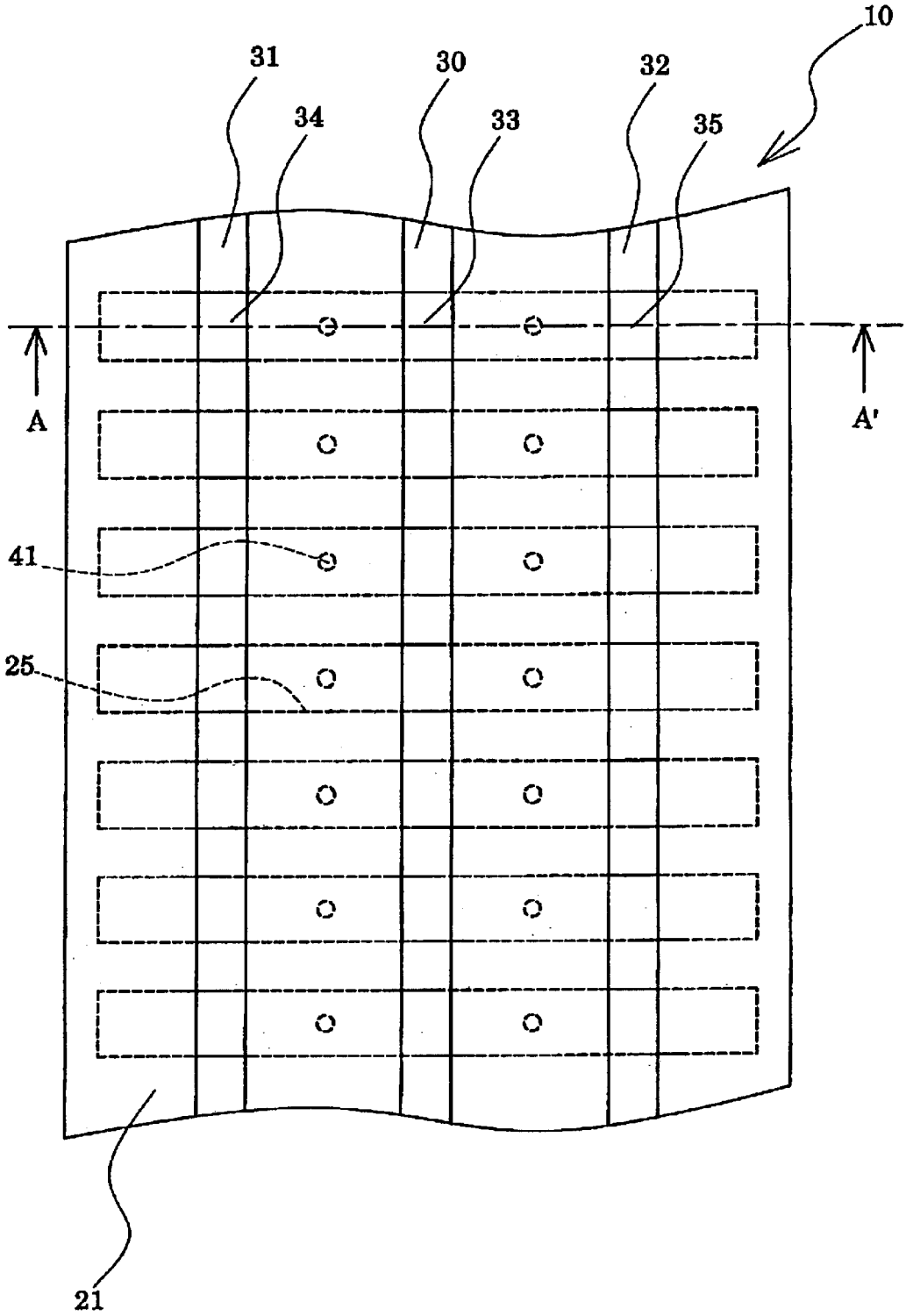
FIG. 2 is a bottom plan view of the head chip according to Embodiment 1 of the present invention.
Figure 3:
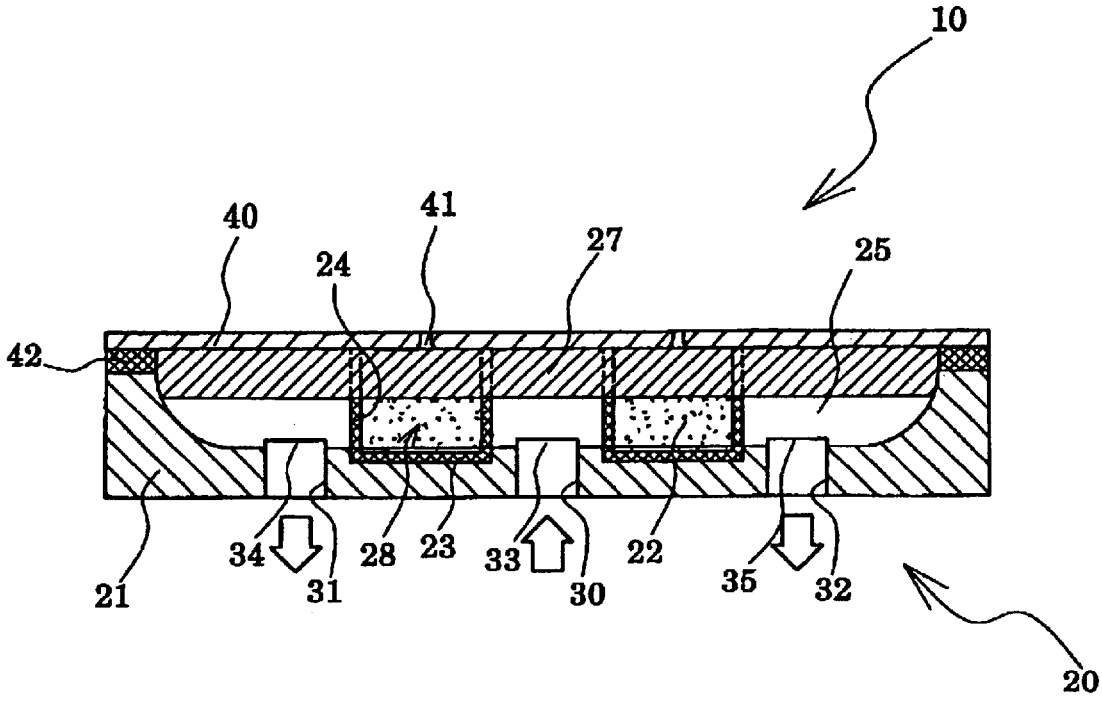
FIG. 3 is a sectional view taken along the line A–A' of FIG. 2, showing the head chip according to Embodiment 1 of the present invention.

FIG. 1 is an exploded perspective view of a head chip according to Embodiment 1 of the present invention; FIG. 2 is a bottom plan view of the head chip of Embodiment 1; and FIG. 3 is a sectional view taken along the line A–A' of FIG. 2.

As shown in the drawings, a head chip 10 of this embodiment includes a substrate 20 having an insulating substrate main body 21 in one surface of which the plurality of (two, in this embodiment) piezoelectric ceramic members 22 are embedded through adhesive 23 so as to extend in a reference direction, and a nozzle plate 40 having nozzle openings 41 which is joined to one surface of the substrate 20.

In one surface of the substrate main body 21, the plurality of (two, in this embodiment) recesses 24 of substantially the same configuration as the piezoelectric ceramic members 22 are formed so as to extend in the reference direction. The piezoelectric ceramic members 22 are joined to these recesses 24 through adhesive 23 so as to be flush with one surface of the substrate main body 21.

The piezoelectric ceramic members 22 consist, for example, of lead zirconate titanate (PZT). There is no particular limitation regarding the material of the substrate main body 21 as long as it is an insulating material. However, taking into account the thermal expansion after the connection thereto of the piezoelectric ceramic members 22, the deformation due to contraction, etc., it is desirable to use a material whose coefficient of linear expansion is close to that of the piezoelectric ceramic members 22 consisting of PZT, for example, alumina. It is also possible to use forresterite whose machinability is equivalent to that of PZT.

Further, the substrate 20 has grooves 25 extending in a direction perpendicular to the reference direction over the row of the piezoelectric ceramic members 22 and defined by side walls 26.

That is, each groove 25 has two regions where a part of the side walls 26 of the substrate 20 is formed by the piezoelectric ceramic members 22.

The thickness of the piezoelectric ceramic members 22 is such that the piezoelectric ceramic members 22, provided in a part of the side walls 26, extend continuously in the reference direction over the bottom surfaces of the grooves 25 formed in the substrate 20, whereby the piezoelectric ceramic members 22 are not easily separated from the substrate main body 21, thus achieving an improvement in terms of rigidity.

Further, the longitudinal end portions of each groove 25 are formed such that the depth of the groove gradually decreases toward the ends in the direction perpendicular to the reference direction of the substrate 20. The end portions of each groove 25 reduced in depth are sealed by adhesive 42 used when joining the nozzle plate 40 described in detail below.

The grooves 25 are formed one by one or collectively at one time with a dicer using a disc-shaped dice cutter, a wire saw using a plurality of wires, or the like.

Further, the piezoelectric ceramic members 22 constituting a part of the side walls 26 defining the grooves 25 are provided with electrodes 27 extending on the inner surfaces of the grooves 25 on the opening side. Due to the electrodes 27, the piezoelectric ceramic members 22 constituting a part of the sidewalls 26 constitute drive portions 28 for independent driving.

Further, the electrodes 27 of the two drive portions 28 of each groove 25 extend on the side wall 26 to the end portions where the depth of the groove 25 decreases, and are discontinuous on the side wall 26 between the drive portions 28 to insulate the electrodes 27 from each other.

Due to this arrangement, it is possible to realize independent driving by selectively applying voltage to the electrodes 27 of the two drive portions 28 of each groove 25.

In the other surface of the substrate 20 on the side opposite to the surface where grooves 25 are formed, there are provided in the regions which are not opposed to the piezoelectric ceramic members 22 a plurality of common grooves 30 through 32 communicating with the bottoms of the grooves 25 and extending in the direction in which the grooves 25 are arranged, i.e., in the reference direction.

In this embodiment, a common groove 30 is provided between the two drive portions 28 with respect to the longitudinal direction of the grooves 25, and common grooves 31 and 32 are provided respectively between the two drive portions 28 and the longitudinal ends of the grooves 25. That is, in this embodiment, three common grooves 30 through 32 are provided.

Of these common grooves 30 through 32, the common groove 30 provided between the two drive portions 28 communicates with the grooves 25 through communication holes, which constitute ink supply holes 33 for supplying ink to the grooves 25, and the common grooves 31 and 32 provided on the longitudinal end sides of the grooves 25 rather than the two drive portions 28 communicate with the grooves 25 through communication holes, which constitute ink discharge holes 34 and 35.

That is, the ink supplied from the common groove 30 is supplied to the grooves through the ink supply holes 33, and flows to the ink discharge holes 34 and 35 provided on the end sides of the grooves 25, whereby it is possible to supply ink to the drive portions 28 provided between the ink supply holes 33 and the ink discharge holes 34 and 35.

The common grooves 30 through 32 are connected to an ink storage portion of an ink tank or the like (not shown) through an ink supply pipe or the like, and the ink discharged from the common grooves 31 and 32 is returned to the ink storage portion, whereby the ink in the ink storage portion circulates, passing through the common groove 30, the grooves 25, and the common grooves 31 and 32.

Further, when the common grooves 30 through 32 are formed so as to extend up to the ends of the substrate 20 in the reference direction, it is necessary to seal the longitudinal ends of the common grooves 30 through 32 by means of sealing layers consisting of adhesive or the like.

When dividing the grooves 25 into groups corresponding to inks of the four colors: black (B), yellow (Y), magenta (M), and cyan (C), it is necessary to divide the common grooves 30 through 32 into four sections corresponding to the colors by sealing layers.

The nozzle plate 40 is joined to one surface of the substrate 20 through adhesive 42, and nozzle openings 41 are formed in the regions of the nozzle plate 40 corresponding to the drive portions 28.

In this embodiment, two rows of drive portions 28 extend in the reference direction of the substrate 20, so that two rows of nozzle openings 41 are arranged side by side in the reference direction.

Further, the nozzle openings 41 are tapered such that, for example, their inner diameter gradually diminishes toward the ejection side. Such nozzle openings 41 can be formed by a laser or the like before or after joining the substrate 20 and the nozzle plate 40 to each other.

Further, although not shown, provided on the surface of the nozzle plate 40 opposed to the recording medium is a water repellent film with water repellency for preventing adhesion of ink, etc., a slip film with hydrophilicity or the like.

The nozzle plate 40 is formed as a single layer plate or a multi-layer plate. For example, when the nozzle plate 40 is formed as a multi-layer plate, joined to a first nozzle plate consisting of a metal plate or one whose surface is insulation-processed or a glass or plastic plate whose surface is covered with a film with rigidity and having a thickness of 10 to 50 $\mu$m, is a second nozzle plate having openings larger than the nozzle openings and consisting of a plate of plastic such as polyimide or a metal foil plate.

In this head chip 10, the plurality of piezoelectric ceramic members 22 are embedded in the substrate main body 21, and the grooves 25 are provided over the rows of the piezoelectric ceramic members 22, so that it is possible to reliably prevent breakage of the side walls 26 defining the grooves 25 during the formation of the grooves 25, thereby achieving an improvement in terms of production yield. Further, since the piezoelectric ceramic members 22 are embedded in the substrate main body 21, there is no need to perform positioning on the piezoelectric ceramic members 22 with respect to predetermined positions, thereby making it possible to form a head chip 10 of high precision with ease.

Further, by providing the plurality of nozzle rows in each of which the nozzle openings 41 are arranged side by side, it is possible to realize high speed printing.

Figure 4A:
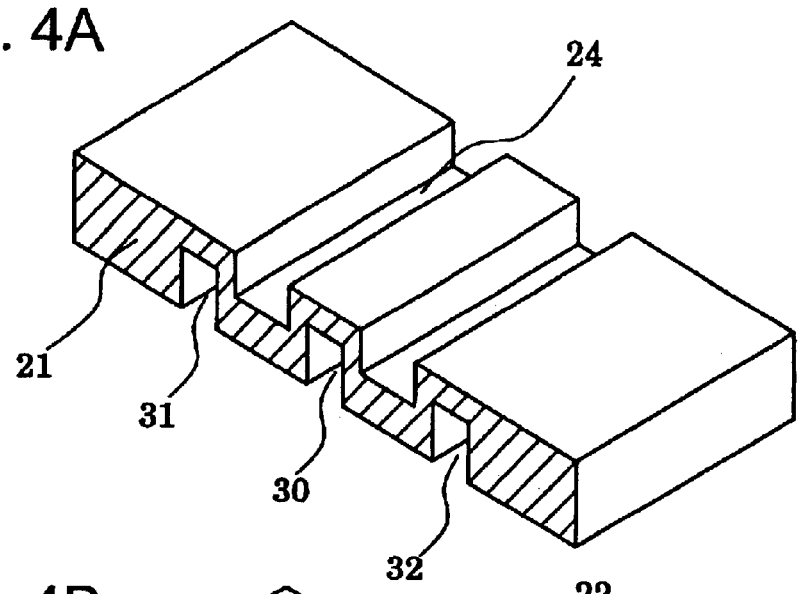
FIGS. 4A through 4C are perspective views showing a method for producing the head chip according to Embodiment 1 of the present invention.
Figure 4B:
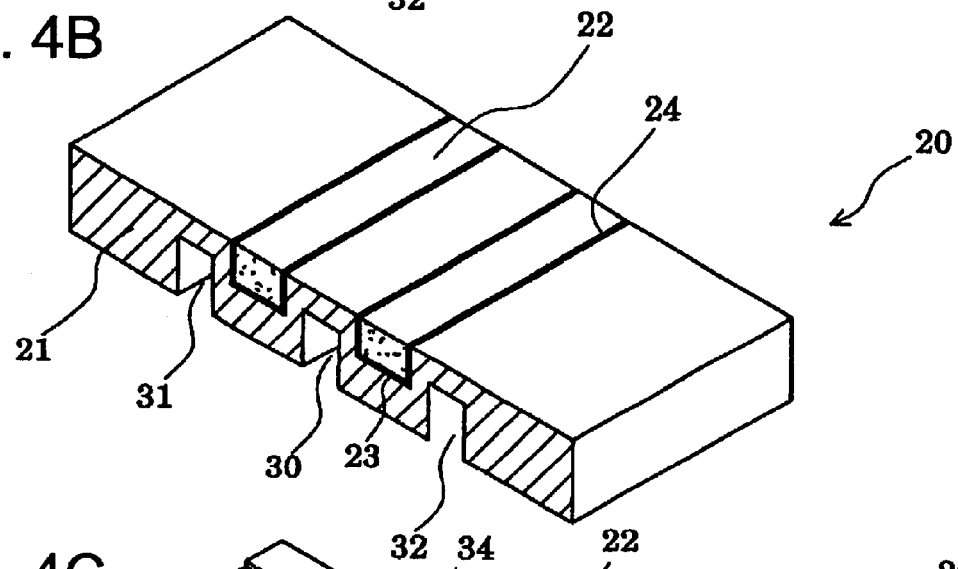
Figure 4C:
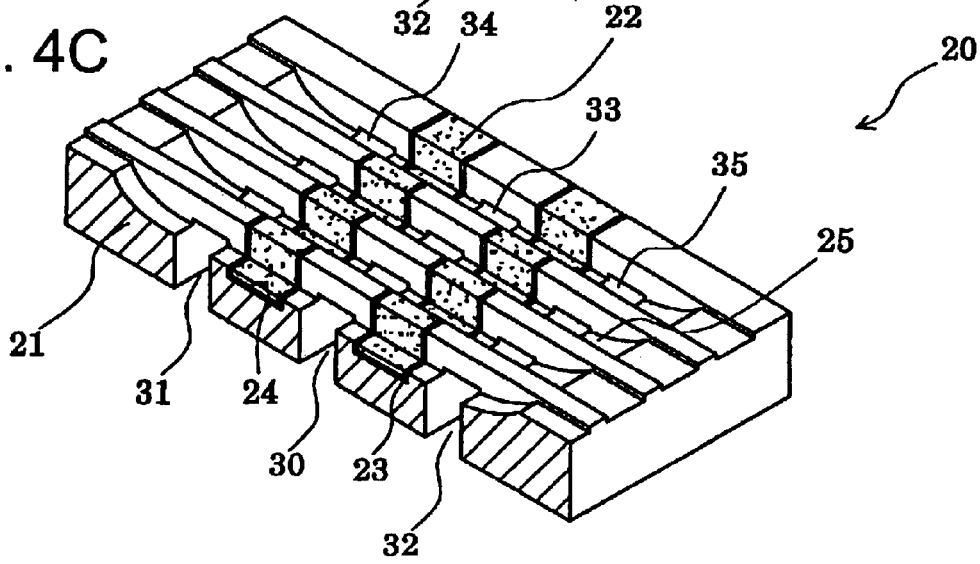

In the following, a method of producing this head chip will be described. FIGS. 4A through 4C are perspective views illustrating the head chip producing method.

First, as shown in FIG. 4A, the recesses 24 in which the piezoelectric ceramic members 22 are to be embedded are formed in one surface of the substrate main body 21, and the common grooves 30 through 32 are formed in the other surface of the substrate main body 21.

The recesses 24 and the common grooves 30 through 32 are formed in the plurality of rows so as to extend in the reference direction.

In this embodiment, two recesses 24 are formed, and the common grooves 30 through 32 are provided in regions which are not opposed to the recesses 24 and which are between the two recesses 24 and on either side thereof, i.e., in three rows in total.

The recesses 24 and the common grooves 30 through 32 can be formed one by one or collectively at one time with a dicer using a disc-shaped dice cutter or a wire saw using the plurality of wires, or the like.

Next, as shown in FIG. 4B, the piezoelectric ceramic members 22 formed in substantially the same configuration as the recesses 24 are embedded in the recesses 24 formed in one surface of the substrate main body 21 by being joined through adhesive 23 to form the substrate 20.

To make the piezoelectric ceramic members 22 flush with one surface of the substrate main body 21, it is possible, for example, to adopt the following arrangement: Piezoelectric ceramic members 22 whose thickness is larger than the depth of the recesses 24 are joined to the substrate main body 21, and then the substrate main body 21 is subjected to lapping together with the piezoelectric ceramic members 22 protruding from one surface thereof, thereby obtaining a flat surface.

Next, as shown in FIG. 4C, the plurality of grooves 25 are formed at predetermined intervals in one surface of the substrate 20 so as to extend in a direction perpendicular to the reference direction.

Like the recesses 24 and the common grooves 30 through 32, the grooves 25 can be formed by a dicer, a wire saw or the like.

By forming the grooves 25, the bottoms of the grooves 25 communicate with the bottoms of the common grooves 30 through 32, making it possible to simultaneously form the ink supply holes 33 and the ink discharge holes 34 and 35.

Thereafter, the electrodes 27 are formed at predetermined positions on the side walls 26 defining the grooves 25 to thereby form the drive portions 28, and the nozzle plate 40 is joined to one surface of the substrate 20 to thereby form the head chip 10 of this embodiment as shown in FIG. 3.

In forming the electrodes 27, the well-known oblique deposition may be adopted. After the formation of the electrodes, the electrodes between the drive portions 28 are removed by a laser or the like. Alternatively, it is possible to adopt the lift-off process, according to which resist is first applied to the surface of the substrate 20, then the grooves 25 are formed by machining and after the formation of the electrodes 27, the resist is peeled off, thereby forming the electrodes 27 exclusively at desired positions.

In the case in which the electrodes 27 are formed by using resist, it is possible to perform a patterning process after the application of the resist, leaving the resist exclusively at desired positions.

The nozzle openings 41 of the nozzle plate 40 may be formed by a laser or the like after the substrate 20 and the nozzle plate 40 have been joined together, or the nozzle openings 41 may be formed before joining the substrate 20 and the nozzle plate 40 to each other.

In this way, in the head chip producing method of this embodiment, the recesses 24 are formed in the substrate main body 21, and a plurality of piezoelectric ceramic members 22 are embedded in the recesses 24 to form the grooves 25, so that it is possible to reliably prevent breakage of the side walls 26 defining the grooves 25 during the formation of the grooves 25, thereby achieving an improvement in production yield.

Further, by embedding the piezoelectric ceramic members 22 in the recesses 24 of the substrate main body 21, there is no need to perform positioning on the piezoelectric ceramic members 22 with respect to predetermined positions, making it possible to form a high precision head chip 10 with ease.

(Embodiment 2)

Figure 5:
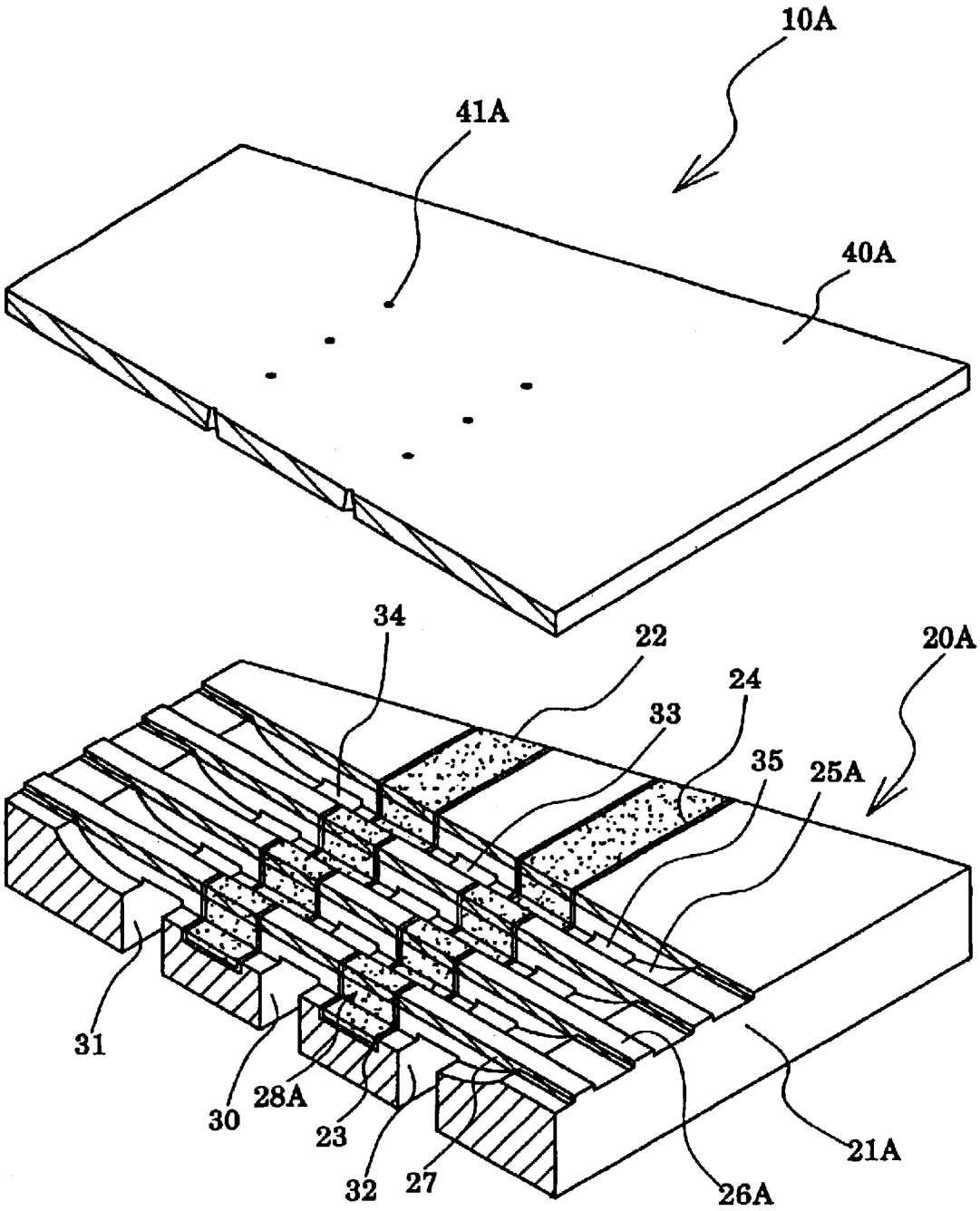
FIG. 5 is an exploded perspective view of a head chip according to Embodiment 2 of the present invention.
Figure 6:
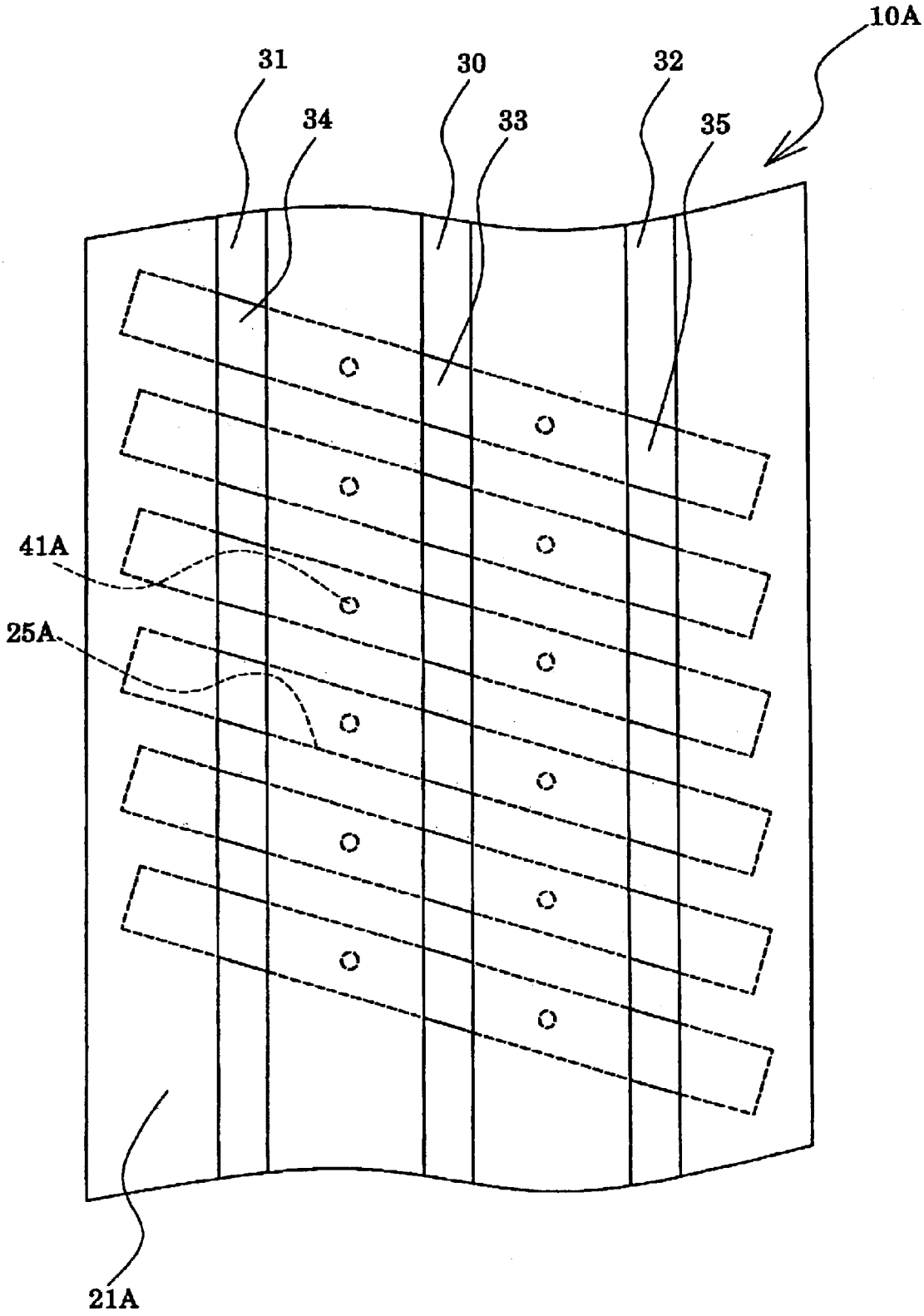
FIG. 6 is a bottom plan view of the head chip according to Embodiment 2 of the present invention.

FIG. 5 is a perspective view of a head chip, and FIG. 6 is a plan view of the head chip. The same components as those of Embodiment 1 are indicated by the same reference numerals, and a description thereof will be omitted.

While in Embodiment 1 the grooves 25 are formed so as to extend in the direction perpendicular to the reference direction over the row of piezoelectric ceramic members 22, in Embodiment 2, the grooves are formed in a direction inclined by a predetermined angle from the direction perpendicular to the reference direction, whereby the positions of all the nozzles in the nozzle rows differ from each other in the reference direction. Otherwise, this embodiment is the same as Embodiment 1.

More specifically, as shown in the drawings, a head chip 10A has a substrate 20A including a substrate main body 21A in one surface of which piezoelectric ceramic members 22 are embedded so as to extend in the reference direction. In the substrate 20A, grooves 25A are formed by being defined by side walls 26A so as to extend in a direction inclined by a predetermined angle from the direction perpendicular to the reference direction over the row of piezoelectric ceramic members 22.

Further, electrodes 27 are formed on the surfaces of the piezoelectric ceramic members 22 defining the grooves 25A, thereby forming drive portions 28A for independent driving.

In this embodiment, the inclination angle of the grooves 25A is determined such that one row of drive portions 28A is deviated in position from the other row in the reference direction, with the result that there is arranged a drive portion 28A of the other row substantially at the center with respect to the reference direction of the space between adjacent drive portions 28A of one row.

That is, the nozzle openings 41A provided in correspondence with the drive portions 28A of the nozzle plate 40A joined to the substrate 20A are arranged such that substantially at the center of the space between nozzle openings 41A of one row adjacent to each other in the reference direction, there is arranged a nozzle opening 41A of the other row.

Due to this arrangement, the pitch of the nozzle openings 41A in the reference direction is reduced to half, making it possible to perform high density printing even in the case of a line type ink-jet recording apparatus.

(Embodiment 3)

In the head chips 10 and 10A of Embodiments 1 and 2, when a conductive ink such as a water-color ink is used, conduction occurs between opposing electrodes 27 of the drive portions 28 and 28A in the grooves 25 and 25A, making it impossible to eject ink. In view of this, this embodiment makes it possible to use a conductive ink in the head chip 10A of Embodiment 2.

Figure 7:
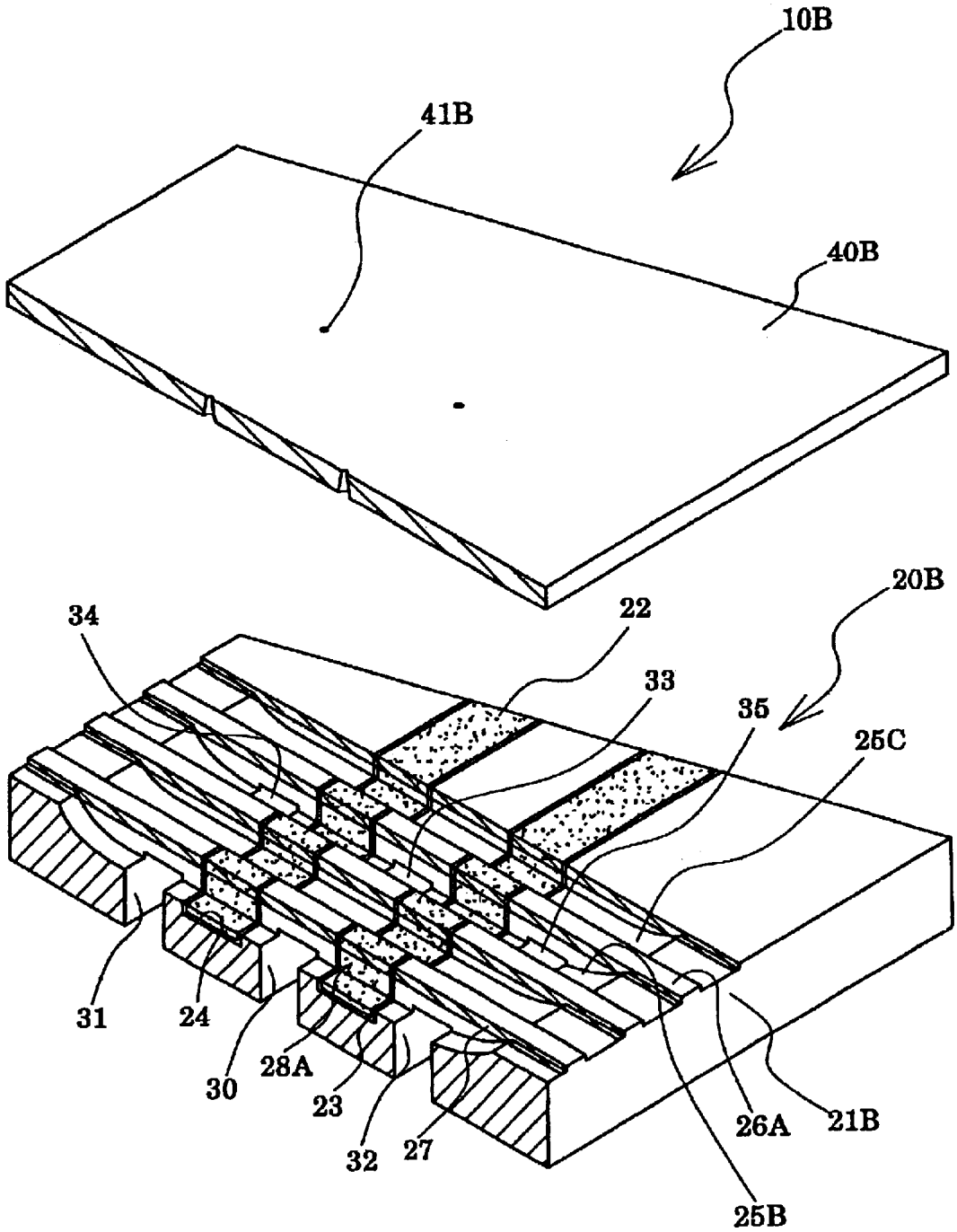
FIG. 7 is an exploded perspective view of a head chip according to Embodiment 3 of the present invention.
Figure 8:
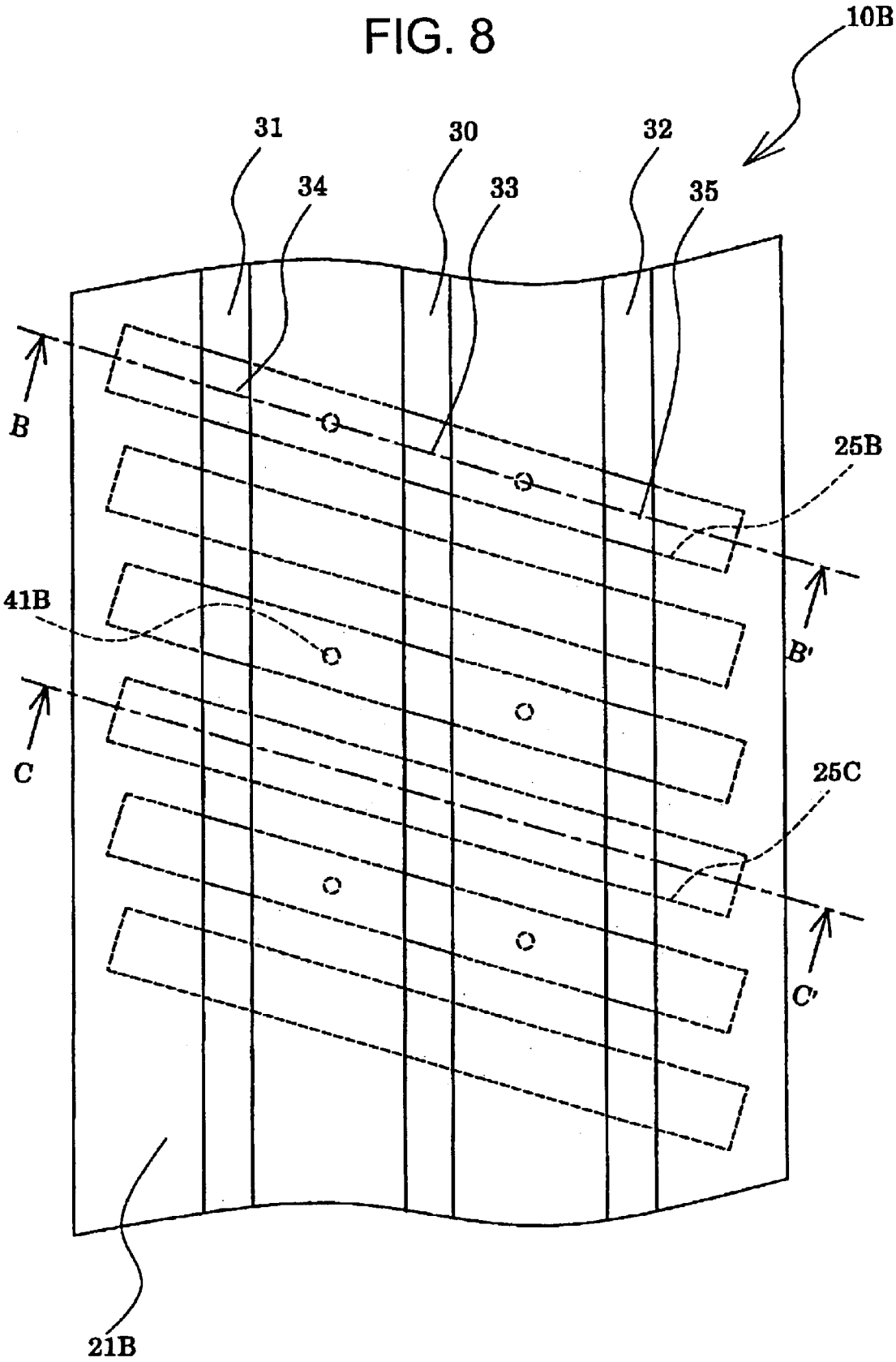
FIG. 8 is a bottom plan view of the head chip according to Embodiment 3 of the present invention.
Figure 9A:
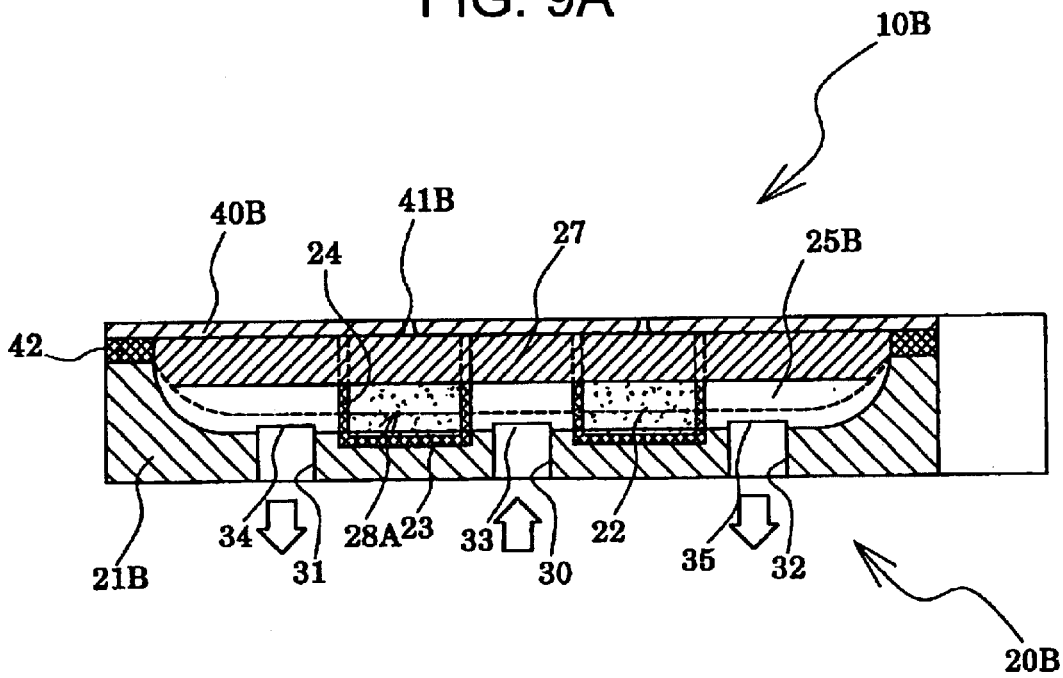
FIGS. 9A and 9B are sectional views taken along the line B–B' and the line C–C' of FIG. 8, showing the head chip according to Embodiment 3 of the present invention.
Figure 9B:
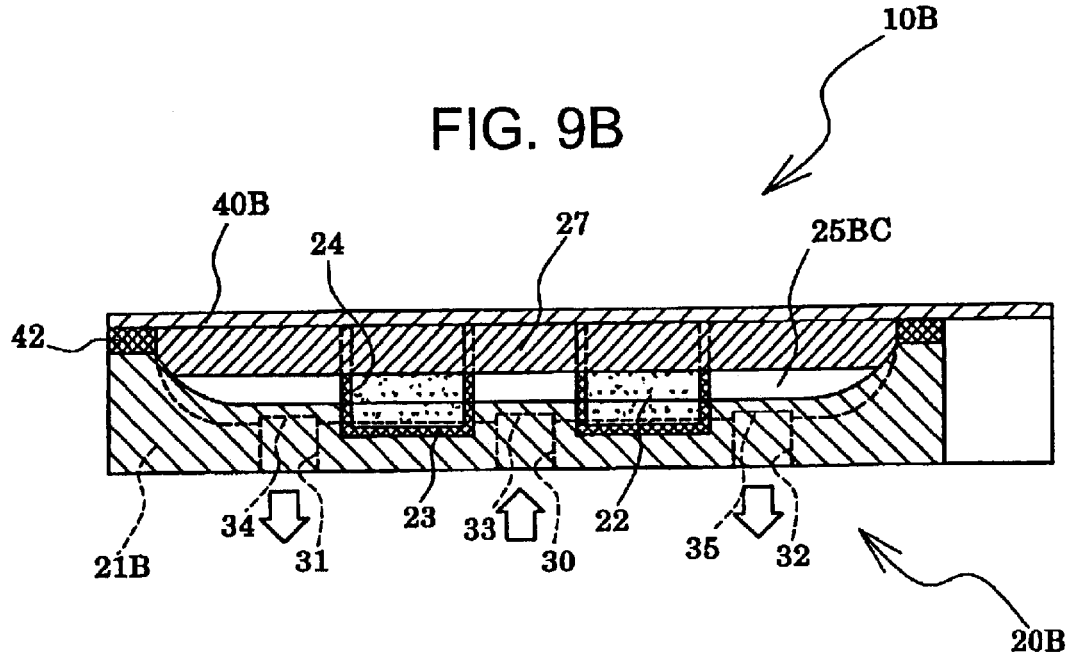
Figure 10A:
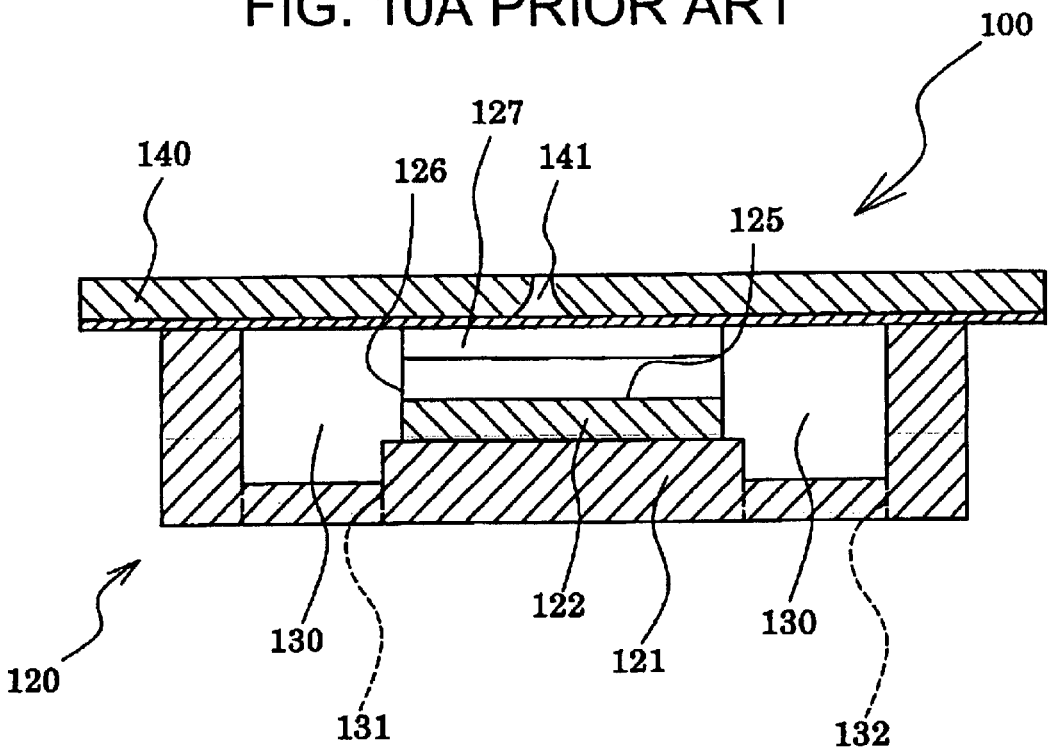
FIG. 10A PRIOR ART
FIGS. 10A and 10B are schematic sectional views of a conventional head chip.
Figure 10B:
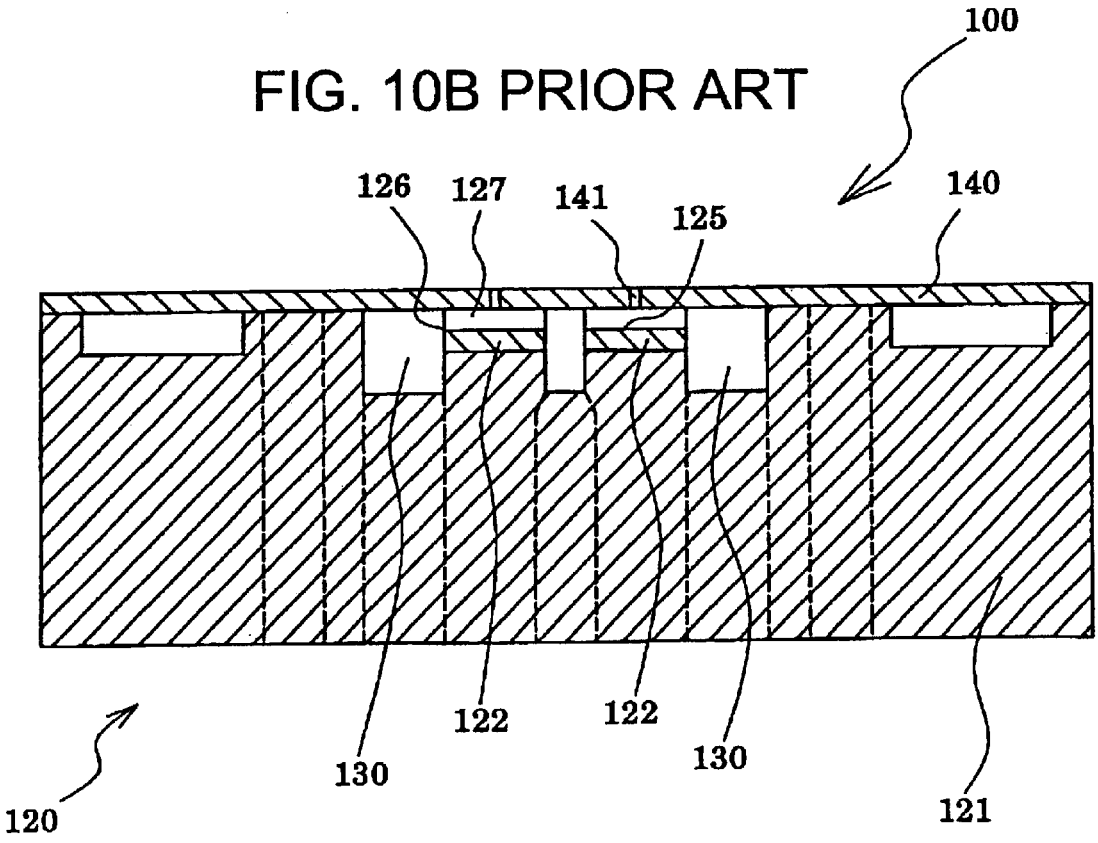
FIG. 10B PRIOR ART
Figure 11:
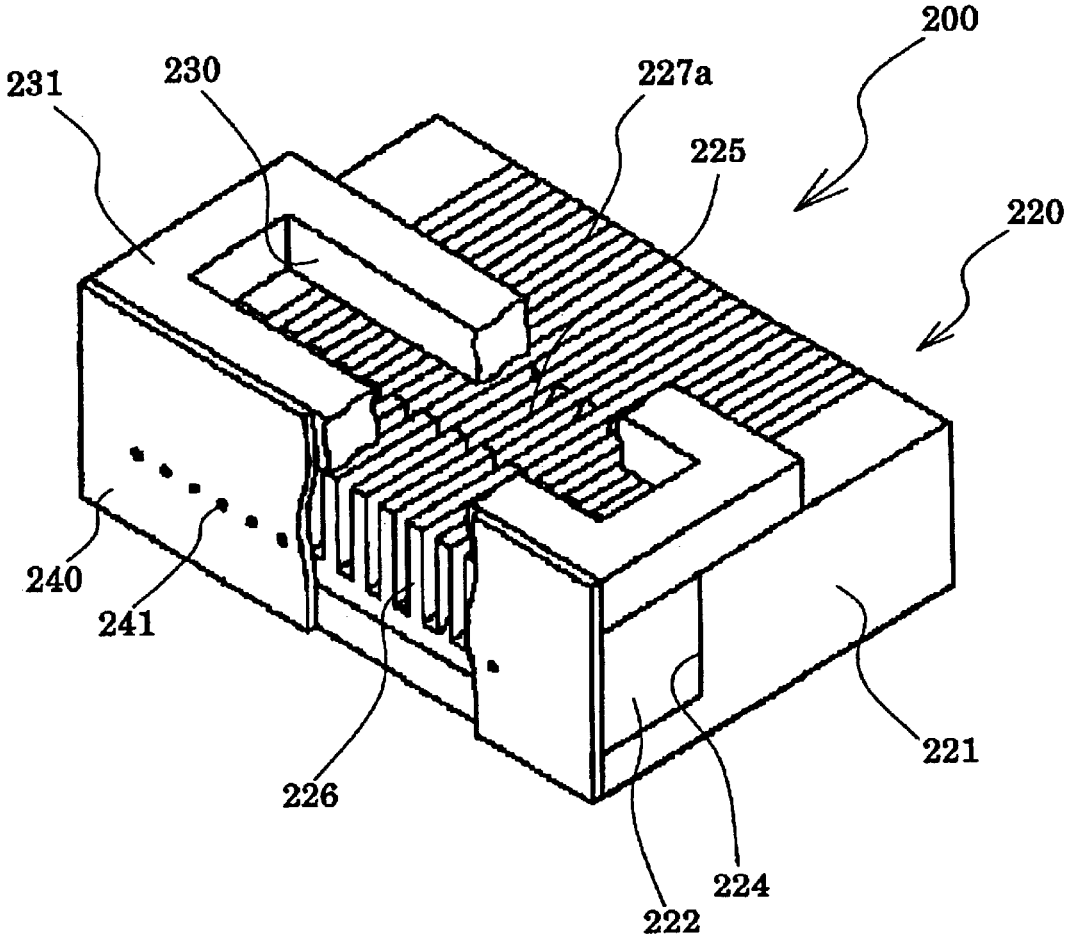
FIG. 11 PRIOR ART
FIG. 11 is a partially cut-away schematic perspective view of a conventional head chip.

FIG. 7 is an exploded perspective view of a head chip according to Embodiment 3, FIG. 8 is a bottom plan view of the head chip, and FIGS. 9A and 9B are sectional views taken along the lines B–B' and C–C' of FIG. 8. The same components as those of Embodiments 1 and 2 are indicated by the same reference numerals, and a description thereof will be omitted.

As shown in the drawings, grooves of different depths are alternately formed in a substrate main body 21B of a substrate 20B of a head chip 10B according to Embodiment 3. The deep grooves serve as chambers 25B, and the shallow grooves serve as dummy chambers 25C.

In the surface of the substrate 20B which is opposite to the other surface where the chambers 25B and the dummy chambers 25C are provided, there are formed three common grooves 30 through 32 extending in the reference direction and communicating exclusively with the bottoms of the chambers 25B to form ink supply holes 33 and ink discharge holes 34 and 35.

Ink is supplied and discharged exclusively to and from the chambers 25B through the common grooves 30 through 32.

When the depth of the common grooves 30 through 32 is the same as that in Embodiments 1 and 2, and only the dummy chambers 25C are shallow, it is possible for the common grooves 30 through 32 to communicate solely with the bottoms of the chambers 25B.

By thus alternately forming the chambers 25B and the dummy chambers 25C having different depths in one surface of the substrate 20B, it is possible for the common grooves 30 through 32 formed in the other surface of the substrate 20B to communicate solely with the bottoms of the chambers 25B, whereby it is possible to supply and discharge ink exclusively to and from the chambers 25B through the common grooves 30 through 32. Thus, the electrodes 27 of the drive portions 28A in the dummy chambers 25C are not short-circuited by the conductive ink, and independent driving can be effected on each of the drive portions 28A of the chambers 25B.

A nozzle plate 40B is joined to one surface of the substrate 20B, and nozzle openings 41B are provided in the nozzle plate 40A solely in correspondence with the drive portions 28A of the chambers 25B.

(Embodiment 4)

Figure 12:
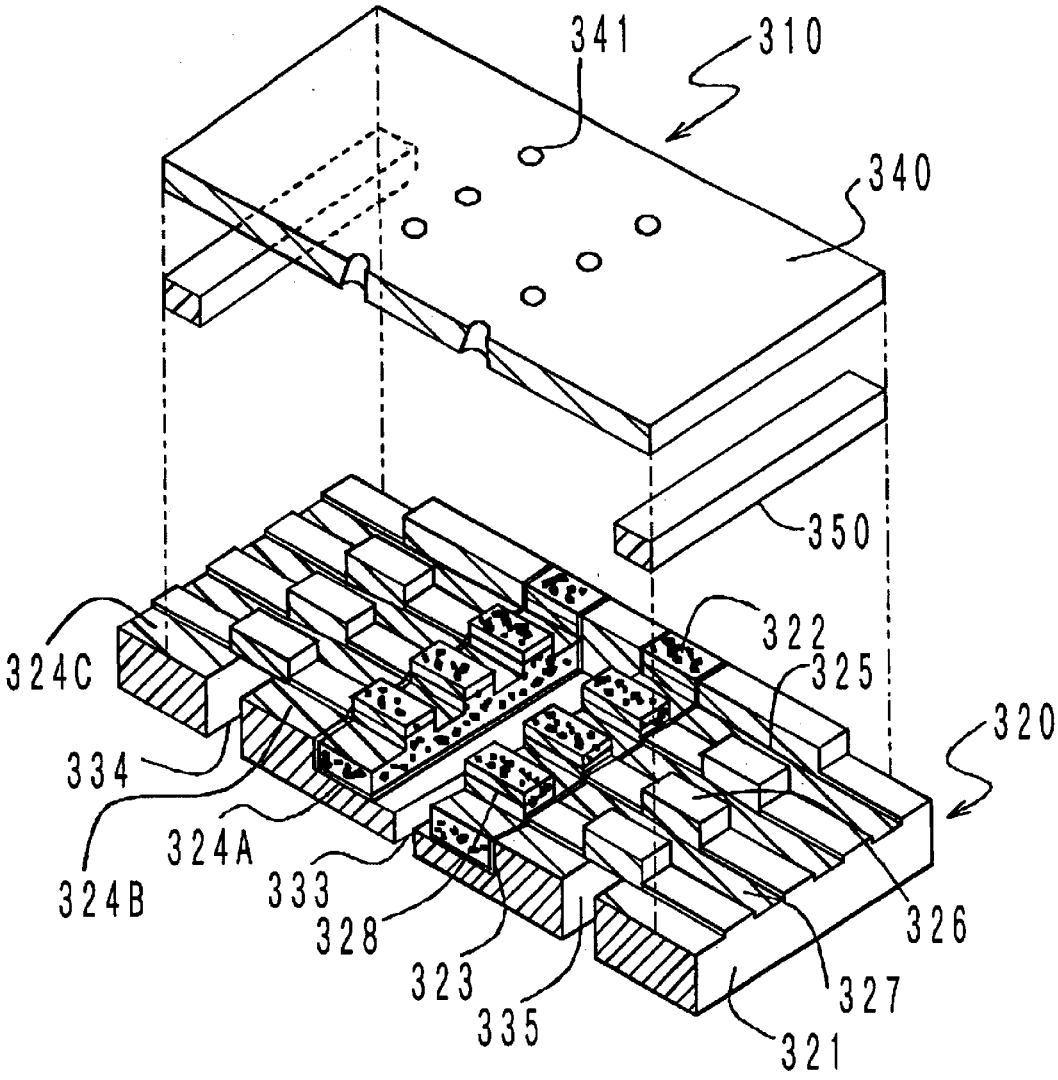
FIG. 12 is an exploded perspective view of a head chip according to Embodiment 4 of the present invention.
Figure 13:
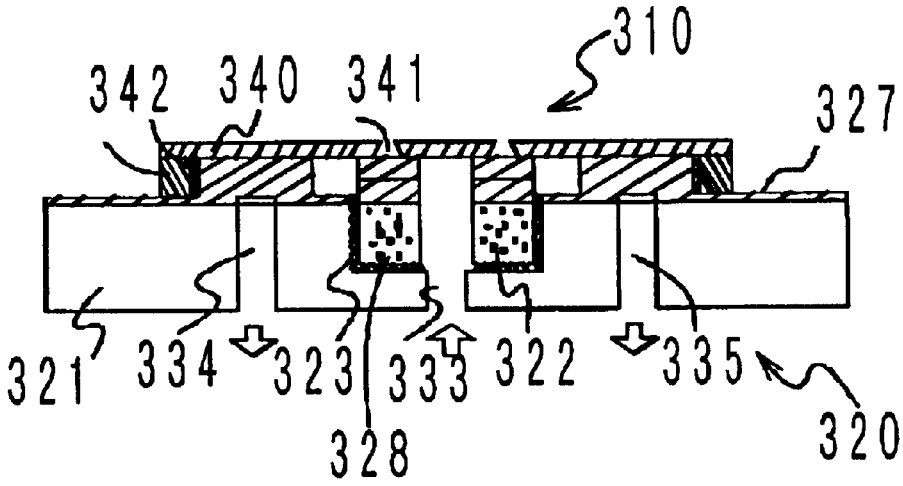
FIG. 13 is a sectional view of the head chip according to Embodiment 4 of the present invention.

FIG. 12 is an exploded perspective view of a head chip according to Embodiment 4, and FIG. 13 is a sectional view of a groove portion thereof.

As shown in the drawings, a head chip 310 according to this embodiment includes a substrate 320 having an insulating substrate main body 321 in one surface of which a plurality of (two in this embodiment) piezoelectric ceramic members 322 are embedded through adhesive 323 so as to extend in the reference direction, and a nozzle plate 340 to be joined to one surface of the substrate 320 and having nozzle openings 341.

In one surface of the substrate main body 321, there are formed a lower recess 324A and upper recesses 324B larger than the piezoelectric ceramic members 322 and extending in the reference direction. The piezoelectric ceramic members 322 are in contact with the bottom portion and side portions of the lower recess 324A, and joined to the substrate main body 321 through the adhesive 323 so as to be flush with one surface thereof.

The materials of the piezoelectric ceramic members 322 and the substrate main body 321 are the same as those of Embodiment 1. Substantially at the center with respect to the depth direction of grooves 325, the piezoelectric ceramic members 322 exhibit different polarizing directions. As in Embodiment 1, the grooves 325, defined by side walls 326, are formed in the substrate 320 so as to extend in the direction perpendicular to the reference direction over the row of piezoelectric ceramic members 322. While in Embodiment 1 each groove becomes gradually shallower at the longitudinal ends, in this embodiment, there are provided at the ends of the substrate 321 end step portions 324C having substantially the same depth as the upper recesses, thus forming the grooves in a uniform depth, whereby the machining with a wire saw using the plurality of wires, which is superior in mass-productivity, is facilitated.

Further, provided on the inner walls of the grooves 325 are electrodes 327, which are formed on the sidewalls of the piezoelectric ceramic members 322, the bottom portions of the upper recesses 324B, and the surfaces of the end step portions 324C. The electrodes 327 leading to the drive portions 328 are insulated, and the drive portions 328 can be independently driven by selectively applying voltage to the electrodes 327.

In the other surface of the substrate 320 on the side opposite to the surface where the grooves 325 are formed, there are formed an ink supply hole 333 situated at the bottom of the lower recess 324A and communicating with the region where there are no piezoelectric ceramic members 322, and ink discharge holes 334 and 335 situated in the regions of the grooves 325 on the end sides with respect to the upper recesses 324B and communicating with at least one groove 325. While in Embodiment 1 common grooves are provided since the grooves are independent regarding the supply and discharge of ink, in this embodiment, the adjacent grooves are connected to the ink, so that communication of a part of the grooves 325 with the ink discharge holes 334 and 335 suffices.

Spacers 350 are attached to the substrate 321 and the nozzle plate 340 by means of adhesive 342 in order to seal the ink discharge side grooves. The nozzle openings 341, the slip film, etc. are the same as those of Embodiment 1, and the nozzle plate 340 may consist of a single layer plate or a multi-layer plate.

With this construction, an impulse wave generated in a drive portion 328 is mainly reflected at that drive portion alone, and the influence of the impulse wave on the other drive portions sharing a groove can be eliminated.

Further, while in this embodiment the ink supply hole 333 and the ink discharge holes 334 and 335 are formed in the other surface of the substrate main body 321, it is also possible to form them in side walls of the substrate main body 321.

Figure 14A:
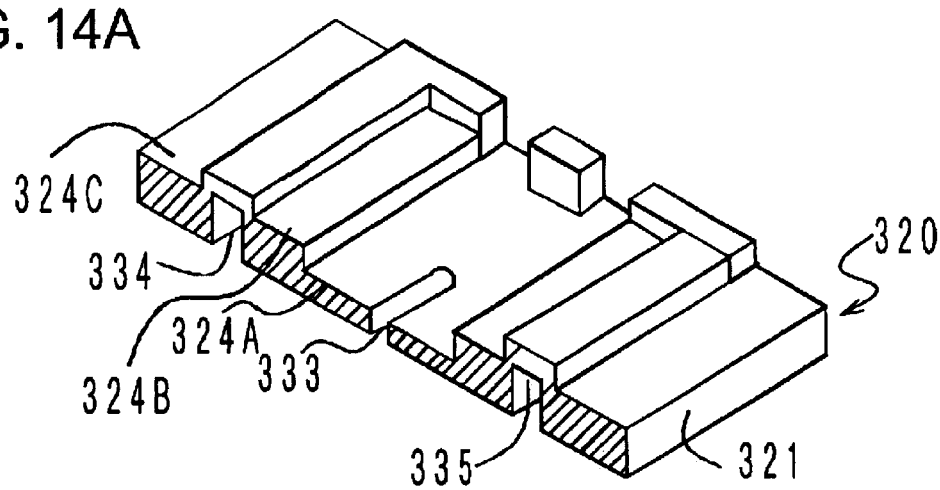
FIGS. 14A through 14C are perspective views of a head chip, illustrating a method for producing the head chip according to Embodiment 4 of the present invention.
Figure 14B:
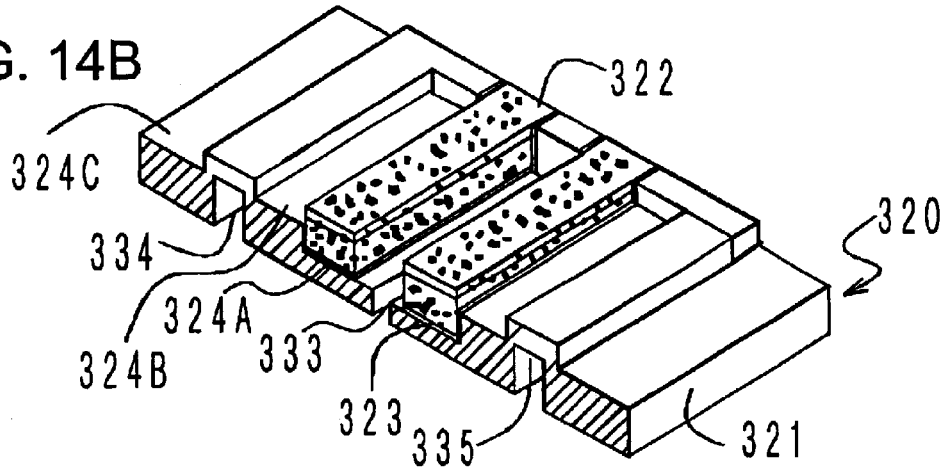
Figure 14C:
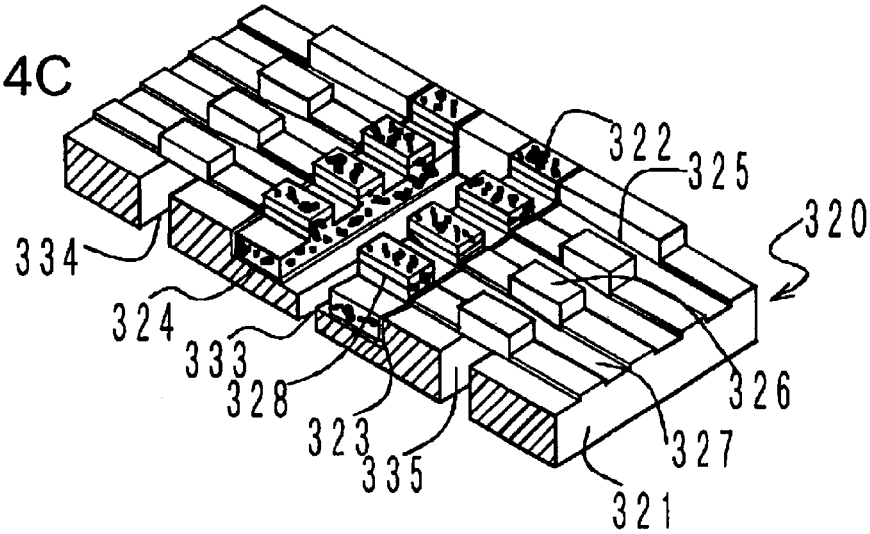

In the following, a method of producing this head chip will be described. FIGS. 14A through 14C are perspective views illustrating the head chip producing method.

First, as shown in FIG. 14A, there are formed in one surface of the substrate main body 321 the lower recess 324A, the upper recesses 324B, and the end step portions 324C substantially of the same depth as the upper recesses 324B, and, in the other surface of the substrate main body 321, there are formed the ink supply hole 333, and the ink discharge holes 334 and 335. This machining of the substrate main body 321 can be effected by molding, or a combination of a dicer, end mill, laser machining, electric discharge machining, etc. for higher precision.

Next, as shown in FIG. 14B, the piezoelectric ceramic members 322 are attached to the step portions of the lower recess 324A, formed in one surface of the substrate main body 321, by means of adhesive 323. The piezoelectric ceramic members 322 used are of the chevron type, which exhibits different polarizing directions substantially at the center with respect to the depth direction of the grooves 325.

Next, as shown in FIG. 14C, by using a dicer, a wire saw or the like, a plurality of grooves 325 are formed at predetermined intervals in one surface of the substrate 320 so as to extend in a direction perpendicular to the reference direction. By forming the grooves 325, the bottoms of the grooves 325 communicate with the ink discharge holes 334 and 335. Thereafter, the electrodes 327 are formed on the inner sides of the grooves 325 to thereby form the drive portions 328. Further, the spacers 350 are joined to the inner sides of the end step portions 324C, and the nozzle plate 340 is joined to one surface of the substrate 320, thereby forming the head chip 310 of this embodiment as shown in FIG. 13.

The formation of the electrodes 327 may be effected by the well-known sputtering, evaporation, electroforming, etc., removing the electrode portions among the drive portions 328 by a laser or the like after the formation. Alternatively, it is possible to apply a sacrificial film such as a resist film to the surface of the substrate 320, and then form the grooves 325 by machining; after the formation of the electrodes 327, the lift-off process is performed to peel off the sacrificial film, thereby forming the electrodes 327 exclusively at desired positions.

Further, when an insulating film, such as polyimide film, oxide film, or parylene film, is applied to the regions where ink comes into contact with the electrodes 327, it is possible to use a conductive ink.

Further, as shown with regard to Embodiment 2, by forming the grooves in a direction inclined by a predetermined angle from the direction perpendicular to the reference direction, it is to possible arrange all the nozzles of the nozzle rows at different positions in the reference direction.

(Other Embodiments)

The basic construction of the head chip of the present invention is not restricted to those of Embodiments 1 through 4 described above.

For example, while in Embodiment 3 a conductive ink is used in the head chip of Embodiment 2, this should not naturally be construed restrictively. In the head chip 10 of Embodiment 1 also, a conductive ink can be used by alternately arranging grooves of different depths.

Further, while in Embodiments 1 through 3 the electrodes 27 are formed exclusively on the open side of the piezoelectric ceramic members 22 exposed on the side walls 26, 26A defining the grooves 25–25C of the substrates 20–20B to obtain the drive portions 28A, this should not be construed restrictively. For example, when piezoelectric ceramic members exhibiting different polarizing directions substantially at the center with respect to the depth direction of the grooves 25–25C are used, and electrodes are provided on the entire surfaces of the side walls 26, 26A where the piezoelectric ceramic members are exposed to form the drive portions, the deformation amount of the drive portions is increased, making it possible to improve the ink ejecting characteristics.

Further, while in the above-described method of producing the head chip 10 of Embodiment 1, the grooves 25 are formed after the recesses 24 and the common grooves 30 through 32 have been formed in the substrate main body 21, this should not be construed restrictively. For example, it is also possible to form the common grooves 30 through 32 after the grooves 25 have been formed in the substrate main body 21.

Further, while in Embodiments 1 through 4 described above the drive portions 28, 28A are provided at two longitudinal positions of each of the grooves 25–25C in the head chips 10–10B, there are no particular limitations regarding the number and positions of the drive portions. By providing a large number of drive portions, it is possible to form an increased number of nozzle rows, making it possible to perform printing of still higher density and higher speed. When the drive portions are provided at three or more longitudinal positions of each groove, it is necessary to lead out the electrodes of the drive portions so that they may not be short-circuited. For example, they may be led out from the nozzle plate side or the ink discharge hole side.

As described above, in accordance with the present invention, the plurality of piezoelectric ceramic members are embedded in the substrate main body, and grooves are provided so as to extend over the row of piezoelectric ceramic members, so that breakage of the side walls defining the grooves during the formation of the grooves is reliably prevented, thereby achieving an improvement in production yield. Further, by embedding the piezoelectric ceramic members in the substrate main body, there is no need to perform positioning on the piezoelectric ceramic members with respect to predetermined positions, thereby making it possible to form a high precision head chip with ease.

Further, by providing the plurality of rows of nozzles each having nozzle openings arranged side by side, it is possible to realize high speed printing, and, by deviating the nozzle rows from each other in the nozzle row direction, it is possible to realize high density printing.

Further, by providing ink supply holes at the bottoms of the grooves and alternately arranging grooves of different depths, it is possible to selectively supply ink to the grooves and to use a conductive ink, such as a water-color ink.

What is claimed is:

1. A head chip in which grooves defined by sidewalls are provided in one surface of a substrate and in which by applying voltage to electrodes provided on the side walls, ink in the grooves is ejected from nozzle openings of a nozzle plate joined to one surface of the substrate, wherein: a plurality of piezoelectric ceramic members extending in a reference direction are embedded in one surface of an insulating main body of the substrate to form the substrate; the grooves are formed at predetermined intervals so as to extend over the row of piezoelectric ceramic members to thereby provide the side walls; the electrodes are provided in the regions of the side walls where the piezoelectric ceramic members are provided to thereby form drive portions for independent driving; and the nozzle openings are provided at positions corresponding to the drive portions of the grooves to form a plurality of nozzle rows.

2. The head chip according to claim 1, wherein: the grooves are formed in a direction inclined by a predetermined angle from a direction perpendicular to the reference direction over the row of piezoelectric ceramic members; and the positions in the reference direction of all the nozzle openings of the plurality of nozzle rows differ from one another.

3. The head chip according to claims 1, wherein in the regions of the other surface of the substrate not opposed to the piezoelectric ceramic members, there are formed an ink supply hole for supplying ink to the grooves and an ink discharge hole for discharging the ink in the grooves.

4. The head chip according to claim 3, wherein: in the regions of the other surface of the substrate not opposed to the piezoelectric ceramic members, there are formed a plurality of common grooves extending in the same direction as the reference direction and over the direction in which the grooves are arranged side by side and communicating with bottoms of the grooves; and communication holes through which the common grooves communicate with the grooves constitute the ink supply hole and the ink discharge hole.

5. The head chip according to claim 4, wherein: the grooves are formed by alternately arranging chambers to be filled with ink and dummy chambers to be filled with no ink; and the dummy chambers are shallower than the chambers, whereby the common grooves communicate exclusively with the bottoms of the chambers.

6. The head chip according to claim 4, wherein the side walls are missing in the regions in contact with the piezoelectric ceramic members.

7. The head chip according to claims 1, wherein: two of the piezoelectric ceramic members are arranged side by side in the substrate; and the electrodes are provided individually on the side walls so as to extend from the ends of the grooves to regions opposed to the drive portions.

8. The head chip according to claims 1, wherein the piezoelectric ceramic members are embedded in the substrate so as to reach the bottoms of the grooves.

9. The head chip according to claim 8, wherein: the piezoelectric ceramic members exhibit different polarizing directions substantially at the center with respect to the depth direction of the grooves; and the electrodes are provided on the entire surfaces of the side walls where the piezoelectric ceramic members are exposed.

10. The headchip according to claims 1, wherein the end portions of the grooves are formed so as to be gradually reduced in depth.

11. The head chip according to claims 1, wherein the substrate is formed of a material whose coefficient of linear expansion is substantially the same as that of the piezoelectric ceramic members.

12. The head chip according to claims 1, wherein the substrate is formed of a ceramic material such as alumina.

13. The head chip producing method comprising: forming a substrate by embedding a plurality of piezoelectric ceramic members extending in a reference direction in one surface of an insulating substrate main body; forming grooves at predetermined intervals so as to extend over the row of piezoelectric members to thereby form side walls defining the grooves; forming electrodes in the regions of the side walls where the piezoelectric ceramic members are provided to thereby form drive portions for independent driving; and joining a nozzle plate in which nozzle openings are provided at equal intervals and in a plurality of rows at positions corresponding to the drive portions of the grooves to one surface of the substrate.

14. The head chip producing method according to claim 13, wherein: in forming the grooves, the grooves are formed in a direction inclined by a predetermined angle from a direction perpendicular to the reference direction; and the positions in the reference direction of all the nozzle openings of the plurality of rows differ from each other.

15. The head chip producing method according to claims 13, wherein in embedding the piezoelectric ceramic members in the substrate, recesses of the same size as the piezoelectric ceramic members are formed in the substrate, and then the piezoelectric ceramic members are joined into the recesses.

16. The head chip producing method according to claims 13, wherein: in embedding the piezoelectric ceramic members in the substrate, a step-like recess having an upper recess and a lower recess having a step portion larger than the piezoelectric ceramic members is formed in the substrate; and the piezoelectric ceramic members are joined to a bottom surface portion of the lower recess and side surface portions of the lower recess.

17. The head chip producing method according to claims 13, further comprising forming, in regions of the other surface of the substrate not opposed to the piezoelectric ceramic members, a plurality of common grooves extending in the same direction as the piezoelectric ceramic members and over the direction in which the grooves are arranged side by side and communicating with the bottom portions of the grooves.

18. The head chip producing method according to claim 17, wherein: in forming the grooves, grooves having different depths are alternately formed; and the common grooves are formed so as not to communicate with bottom portions of shallower grooves.

19. The head chip producing method according to claims 13, wherein in embedding the piezoelectric ceramic members in the substrate, the piezoelectric ceramic members are embedded in the substrate so as to reach the bottom surfaces of the grooves.

20. The head chip producing method according to claim 19, wherein: the piezoelectric ceramic members exhibit different polarizing directions substantially at the center with respect to the depth direction of the grooves; and in forming the drive portions, the electrodes are provided on the entire surfaces of the side walls where the piezoelectric ceramic members are exposed.

* * * * *